United States Patent [19]

Nienstedt

[11] Patent Number: 4,881,377

[45] Date of Patent: Nov. 21, 1989

[54] APPARATUS FOR DIVIDING PARALLELIPIPEDIC BLOCKS OF DEEP FROZEN FOODSTUFFS INTO SMALLER UNITS

[76] Inventor: Heinz Nienstedt, Zum Nonnenberg 8 A, D - 4350 Recklinghausen, Fed. Rep. of Germany

[21] Appl. No.: 238,299

[22] Filed: Aug. 30, 1988

[30] Foreign Application Priority Data

Sep. 4, 1987 [DE] Fed. Rep. of Germany ..... 3729547
Jun. 28, 1988 [DE] Fed. Rep. of Germany ..... 3821712

[51] Int. Cl.[4] ..... F17C 5/02

[52] U.S. Cl. ..... 62/320; 62/341; 83/425.1; 83/425.3

[58] Field of Search ..... 62/320, 341; 83/425.1, 83/425.2, 425.3, 425.4

[56] References Cited

U.S. PATENT DOCUMENTS

| | | | |
|---|---|---|---|
| 3,340,910 | 9/1967 | Summerland | 83/425.3 |
| 3,990,336 | 11/1976 | Soodalter | 83/425.3 |
| 4,151,622 | 5/1979 | Mohrbach | 83/425.3 |
| 4,548,105 | 10/1985 | Koutonen | 83/425.4 |
| 4,733,437 | 3/1988 | Nienstedt | 83/425.3 |

*Primary Examiner*—Ronald C. Capossela

*Attorney, Agent, or Firm*—Marmorek, Guttman & Rubenstein

[57] ABSTRACT

The invention relates to an apparatus for dividing parallelipipedic blocks 1 of deep-frozen foodstuffs and feedstuffs into smaller parallelipipedic units (slabs). Disposed below a conveying path 8 for the blocks 13 to be divided is another conveying path 3 having a conveying direction T2 opposite to the conveying direction T5 of the first conveying path. Disposed above and below the first conveying path 8 are multi-blade circular saws 12, 16 which subdivide the supplied blocks 13 into slices. Associated with the top circular saw 12 is an interception and applicator unit 14, 15 for the material cut up by the circular saw 12. The material cut up by the circular saw 16 is intercepted by the blocks 12 conveyed under the circular saw 16. Associated with a deflecting unit 4 for the blocks 1 disposed between the bottom conveying path 3 and the top conveying path 8 is a dimensioning unit 11 preceded by a once-through freezing chamber 10. The blocks 1 abutting one another at their end faces are frozen together at the joint, so that unusable residual slices are no longer produced during cutting to length. These features result in geometrically precise blocks which can be divided into geometrically precise slabs by the circular saws 12, 16. As a result the required weight can be maintained with the closest tolerances.

6 Claims, 2 Drawing Sheets

APPARATUS FOR DIVIDING PARALLELIPIPEDIC BLOCKS OF DEEP FROZEN FOODSTUFFS INTO SMALLER UNITS

The invention relates to an apparatus for dividing parallelipipedic blocks of deep frozen foodstuffs or feedstuffs into smaller parallelipipedic units (slabs), comprising: a circular saw which is formed by a number of blades disposed one beside the other on a driving shaft and is disposed above a main conveying path formed by a plate for the blocks, the circular saw being at a smaller distance from the main conveying path than the height of the blocks: parting elements, aligned with the blades of the circular saw, for parting those webs of the blocks which were not parted by the blades of the circular saw; and an interception and applicator unit which is associated with the circular saw and by means of which the material cut up by the circular saw can be applied to the blocks or the smaller units.

Apparatuses of the kind specified are required to produce as little cutting loss as possible during dividing, while the smaller units must have precise geometrical dimensions. Only when the smaller units have precise geometrical dimensions is it possible to ensure that all the even smaller parallelipipedic units into which the smaller units are again divided have the required weight for sales purposes. On the one hand, smaller units intended for sale must not be deficient in weight, while on the other hand excess weight is not paid for.

In a prior art apparatus of the kind specified the cutting loss during division is reduced by the saw being disposed above the closed plate of the main conveying path, an interception and applicator unit associated with the saw being provided by means of which cut-up material is intercepted and reapplied to the smaller units. Since the circular saw blades disposed above the plate do not completely part the block, but leave a small web behind, such webs must be parted by fixed parting means taking the form of cutting edges. A considerable thrust is therefore required for a large number of smaller units. Breakage edges are also produced in the zone of the webs which may be a hindrance to further processing.

An apparatus for dividing parallelipipedic blocks is also known which operates with a band saw. One difficulty in using band saws is the high cutting loss, because the cut-up material cannot be intercepted and reapplied, as in the case of the aforedescribed prior art apparatus having the circular saw. Another disadvantage is that with a band saw the cuts cannot be performed as precisely as with a rigid circular saw blade. When adjusted harder in the deep frozen block, there is a risk that the saw band will be laterally deflected so that during subsequent parting the limit of tolerance will be exceeded or not met in both the plus and minus directions, and therefore the precise dimensions required for the exact weight in the smaller units are not achieved, and moreover smaller units may remain hanging from the guides designed for precise dimensions.

Another problem in the parting of parallelipipedic blocks is that the "raw blocks" must be prepared for the apparatus for cutting up into smaller blocks by having been divided into the correct length for processing in the apparatus. The result is that slices of varying thickness are left over at the end faces.

It is an object of the invention to provide an apparatus of the kind specified by means of which smaller units (slabs) can be produced from blocks with even less cutting loss.

To this end according to the invention the parting elements are constructed in the form of blades of another circular saw disposed beneath the plate of the main conveying path which engage through the plate of the main conveying path to such an extent that the webs of the blocks are at least substantially parted; disposed beneath the plate of the main conveying path is a subsidiary conveying path having a conveying direction opposite to the conveying direction of the main conveying path; and disposed between the end of the subsidiary conveying path and the start of the main conveying path is a deflecting unit by which the blocks arriving can be transferred from the subsidiary conveying path to the main conveying path.

The use of two circular saws above and beneath the plate of the main conveying path ensures clean cuts without breakage edges in the smaller units. Although the plate of the main conveying part is not closed, cutting losses are not increased in comparison with the prior art apparatus having the closed plate, since the cut-up material dropping below the plate is intercepted by the blocks moving on the opposite conveying path.

To keep cutting losses as low as possible also during the division of the blocks into the size for processing in the apparatus, according to one feature of the invention a transverse conveying path with a conveying direction transverse of the conveying direction of the first conveying path is provided at the start of one of the conveying paths, more particularly the main conveying path, and disposed at the transition from the subsidiary conveying path to the main conveying path is a dimensioning unit by which the deep frozen foodstuffs or feedstuffs, supplied in the form of a rectangular strand, can be divided into the individual blocks.

The feeding of the "raw blocks" in the form of a strand frozen together at the end faces ensures that the end faces of the "raw blocks" can no longer be processed at the same time. The freezing together of the "raw blocks" at the end faces can be produced either by the inherent cold of the "raw blocks" or in a once-through freezing chamber, a liquid or pasty substance from the material of the blocks being preferably fed to the abutting end faces of the "raw blocks" at the parting line.

The end face freezing together of the "raw blocks" and their division into the correct length for the circular saw can also be performed independently of the two-path conveying of the blocks over one another.

An embodiment of the invention will now be described in detail with reference to the diagrammatic drawings, wherein.

Figure 1:
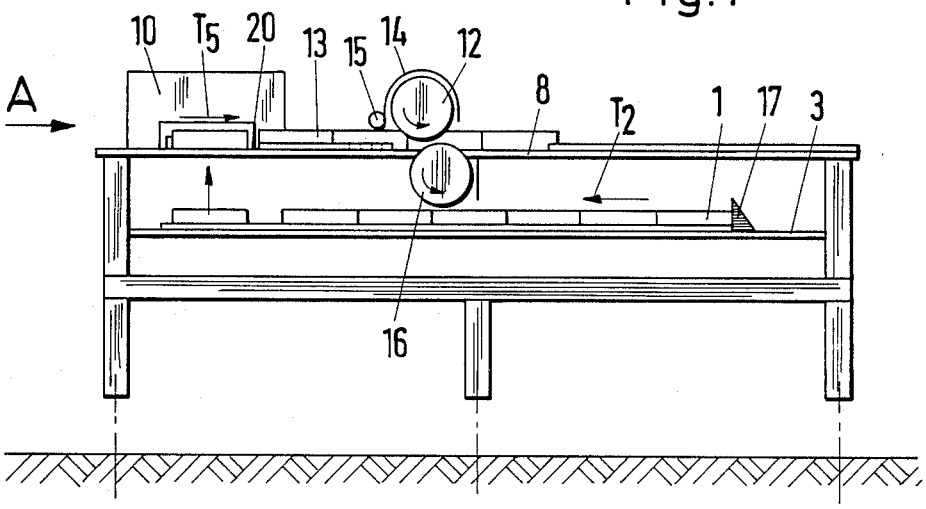
FIG. 1 is a side elevation of the apparatus for dividing parallelipipedic blocks.
Figure 2:
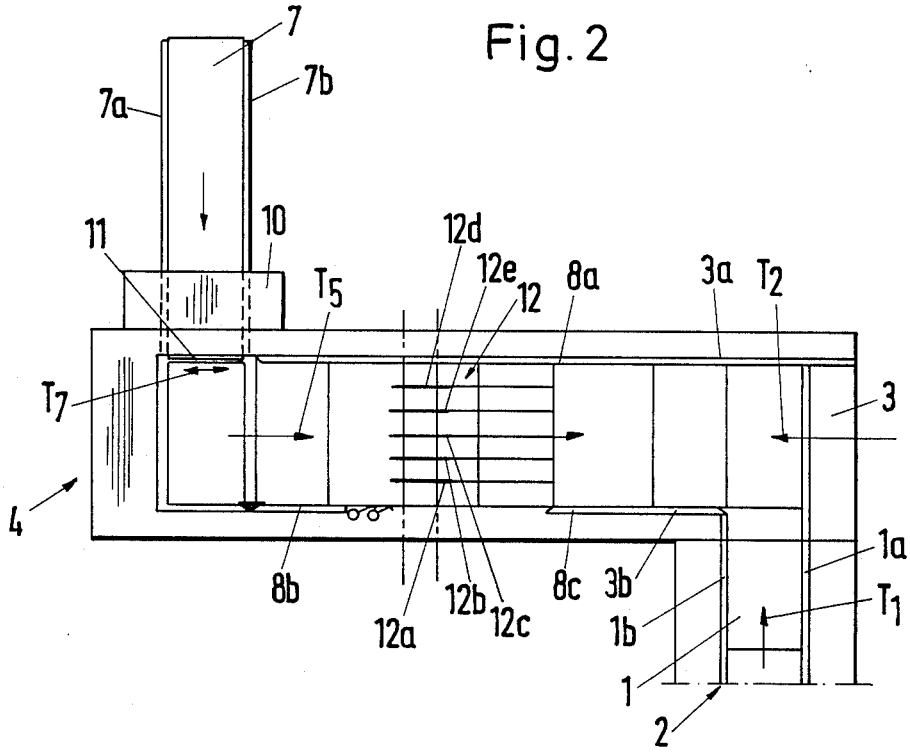
FIG. 2 is an elevation of the apparatus shown in FIG. 1.
Figure 3:
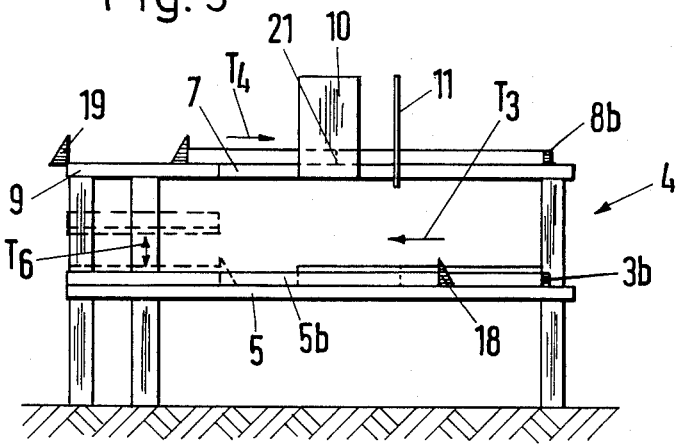
FIG. 3 is a side elevation of the apparatus illustrated in FIGS. 1 and 2 viewed in the direction of the arrow A in FIG. 2.

Deep frozen raw blocks 1 of rectangular cross-section are pushed in the transverse direction over a lower transverse conveying path 2 on to a lower subsidiary conveying path 3. Via the lower longitudinal conveying path 3 the blocks 1 are fed in the longitudinal position to a deflecting unit 4 disposed at the end of the longitudinal conveying path 3. The deflecting unit 4 comprises another lower transverse conveying path 5, a lifting table 9 and an upper opposite transverse conveying path 7 extending to an upper main longitudinal conveying path 8. The conveying directions of the individual conveying paths are indicated by the arrows T1, T2, T3, T4, T5. The conveying paths 1, 3, 5, 7, 8 can be formed by grids or plates. Guide strips 1*a*, 1*b*, 3*a*, 3*b*, 5*a*, 5*b*, 7*a*, 7*b*, 8*a*, 8*b*, 8*c* are provided for the lateral guidance of the parts to be conveyed.

The deflecting unit 4 comprises a lifting table 9 can be raised from the level of the lower transverse conveying path 5 to the level of the upper transverse conveying path 7. The movement of the lifting table 9 is indicated by the double arrow T6. A once-through freezing chamber 10 is disposed on the upper transverse conveying path 7. Disposed in the conveying direction downstream of the once-through freezing chamber 10 at the transition from the transverse conveying path 7 to the upper main conveying path 8 is a saw 11 which can be moved in the direction indicated by arrow T7. The saw 11 cuts to length the blocks to be divided.

Disposed above the plate of the main conveying path 8 is a circular saw 12 whose blades 12a to 12d are disposed spaced out on a common driving shaft and at a distance from the upper side of the plate of the conveying path 8 which is smaller than the height of the divided blocks 13 supplied. Associated with the circular saw 12 is an interception and applicator unit comprising a hood 14 which encloses the circular saw 12 and a contact pressure roller 15 which applies the cut-up material uniformly to the top sides of the blocks.

Disposed beneath the plate of the main conveying path 8 and in the conveying direction T5 of the circular saw 12 is another circular saw 16 whose blades engage through the plate of the conveying path 8 far enough for the webs not parted by the circular saw 12 to be completely or at least almost completely parted.

Entraining elements 17, 18, 19, 20 are used to convey the blocks 1, 13.

The operation of the embodiment of the invention will now be explained:

The raw blocks 1 are pushed in the transverse direction, bearing against one another by their end faces, on to the subsidiary conveying path 3, over which they are advanced by the entraining elements 17 in the transverse position and also abutting one another to the deflecting unit 4. At the end of the subsidiary conveying path 3 the blocks 1 are again pushed in the longitudinal direction on to a susidiary conveying path 5 by means of entraining elements 18 to the lifting table 9. The lefting table 9 lifts the blocks to the level of the upper transverse conveying path 7, where they are pushed by entraining elements 19 through the once-through freezing unit 10. Before they arrive in the once-through freezing unit 10, a liquid or pasty substance of the material of the blocks is introduced between the end faces. In the freezing unit 10 the blocks then freeze together at the joint 21. The blocks are then further advanced as far as a guide strip 8b, which forms a stop, and in that position are divided by the saw 11 into the required lengths. From that point the blocks 13 are again advanced in the transverse position to the two circular saws 12, 16, where they are cut up into individual slabs. The cut-up material produced by the upper circular saw is intercepted by the hood 14 and reapplied by the roller 15. The material cut up by the lower circular saw 16 is applied to the top sides of the blocks 1 conveyed on the lower subsidiary conveying path 3.

With the apparatus according to the invention the total cutting loss is extremely small, since cut-up material accumulating on the circular saws 12, 16 is reapplied and upstream of the circular saws 12, 16 the end faces of the slabs to be cut up into smaller units have been geometrically precisely shaped by the division of the deep frozen foodstuffs supplied in the form of a strand, without the occurrence of slices which cannot be used.

I claim:

1. An apparatus for dividing parallelpipedic blocks of deep frozen foodstuffs into smaller parallelpipedic units, comprising:

a main conveying path, a first circular saw comprising a plurality of parallel blades mounted on a common drive shaft, said blades being disposed above said main conveying path at a distance from said main conveying path which is smaller than the height of said parallelpipedic blocks;

a second circular saw comprising a second plurality of blades disposed beneath said main conveying path and protruding through said main conveying path, said blades of said second circular saw being aligned with said blades of said first circular saw so as to act as parting means for separating said smaller parallelpipedic units which are not separated by said blades of said first circular saw;

a subsidiary conveying path disposed beneath said main conveying path and running parallel to said main conveying path; and lifting means for transferring arriving parallelpipedic blocks from said subsidiary conveying path to said main conveying path.

2. The apparatus of claim 1 wherein said main conveying path comprises a plate with apertures therein for receiving said blades of said second circular saw.

3. The apparatus of claim 1 further comprising interception and application means associated with said first circular saw for receiving excess material cut off from said parallelpipedic blocks and for applying said cutoff material to said parallelpipedic blocks or units.

4. The apparatus of claim 1 wherein said lifting means is located between the end of said subsidiary path and the start of said main conveying path.

5. The apparatus of claim 1 further comprising a transverse conveying path leading from said subsidiary conveying path to said main conveying path, and dimensioning means located at the transition from said transverse conveying path to said main conveying path for dimensioning said frozen foodstuffs to an initial size prior to introduction onto said main conveying path.

6. The apparatus of claim 5 further comprising once-through freezing means disposed on said transverse conveying path.

* * * * *